US006149120A

United States Patent [19]

Hall

[11] Patent Number: 6,149,120

[45] Date of Patent: Nov. 21, 2000

[54] LOW PROFILE SLIDABLE SHELF

[76] Inventor: Donald M. Hall, 63 N. Country Rd., Mt. Sinai, N.Y. 11766

[21] Appl. No.: 09/049,128

[22] Filed: Mar. 27, 1998

Related U.S. Application Data

[60] Provisional application No. 60/042,471, Mar. 27, 1997.

[51] Int. Cl.[7] ..... F16M 13/00

[52] U.S. Cl. ..... 248/580; 248/298.1; 108/143

[58] Field of Search ..... 248/580, 581, 248/121, 295.11, 298.1, 297.21; 108/134, 143, 42, 47, 48, 61, 102, 137; 269/73; 312/122, 281, 317.3

[56] References Cited

U.S. PATENT DOCUMENTS

| | | | |
|---|---|---|---|
| 370,109 | 9/1887 | Waldorf | 16/106 |
| 768,041 | 8/1904 | George | 248/657 |
| 1,208,979 | 12/1916 | Kahre | 108/134 |
| 1,572,456 | 2/1926 | Wicke | 312/116 |
| 1,701,039 | 2/1929 | Hem | 177/163 |
| 1,868,304 | 7/1932 | Cargill | 248/298.1 |
| 1,873,852 | 8/1932 | Rorrer et al. | 52/33 |
| 1,987,796 | 1/1935 | Rorrer et al. | 312/117 |
| 2,774,182 | 12/1956 | Beder | 446/227 |
| 2,803,986 | 8/1957 | Choiniere et al. | 359/503 |
| 3,279,548 | 10/1966 | Boukair | 177/60 |
| 3,757,967 | 9/1973 | Colbridge | 214/16.4 R |
| 3,934,829 | 1/1976 | Coucher | 241/259.1 |
| 3,938,602 | 2/1976 | Sly et al. | 177/116 |
| 4,227,464 | 10/1980 | Wallace | 104/126 |
| 4,628,756 | 12/1986 | Kimura et al. | 74/479 |
| 4,729,536 | 3/1988 | Scala | 108/143 X |
| 4,763,738 | 8/1988 | Kuchler | 177/50 |
| 5,072,838 | 12/1991 | Price, Jr. et al. | 211/162 |
| 5,232,061 | 8/1993 | Neeleman | 177/184 |
| 5,330,064 | 7/1994 | Hall | 211/182 |
| 5,386,787 | 2/1995 | Hall | 108/143 |
| 5,456,191 | 10/1995 | Hall | 108/147 |
| 5,471,922 | 12/1995 | Hall | 108/143 |
| 5,503,087 | 4/1996 | Hall | 108/143 |
| 5,628,522 | 5/1997 | Hall | 280/43.17 |

FOREIGN PATENT DOCUMENTS

| | | |
|---|---|---|
| 6508781 | 1/1966 | Netherlands . |
| 429659 | 7/1967 | Switzerland . |
| 1217084 | 2/1967 | United Kingdom . |

*Primary Examiner*—Ramon O. Ramirez
*Assistant Examiner*—Gwendolyn Baxter
*Attorney, Agent, or Firm*—Shlesinger, Arkwright & Garvey LLP

[57] ABSTRACT

This invention pertains to a device having a first and second upright, a support rail connecting the first upright and the second upright, and a vertical spacer having a first edge, a second edge and a bearing surface. A portion of the first edge is disposed on the first upright and a portion of the first edge is disposed on the second upright. A guide rail having a top surface is disposed along the second edge of the vertical spacer. The guide rail extends over the bearing surface. The device further includes a sliding support member having a first roller, a second roller and a third roller. The first roller engages the top surface of the guide rail and is oriented for transmitting substantially only vertical forces from the sliding support member to the top surface. The second roller engages the support rail and is oriented for transmitting substantially only horizontal forces from the sliding support member to the support rail. The third roller is disposed beneath the top surface of the guide rail and the first roller, and engages the bearing surface of the vertical spacer. The third roller is oriented for transmitting substantially only horizontal forces from the sliding support member to the bearing surface section.

4 Claims, 19 Drawing Sheets rail w/o pulley

By providing locking bolts, the height of each leg assy. can be adjusted to compensate for floor conditions.

(2) O.D. engages (1) I.D.

(2) I.D. engages (3) O.D.

(A) I.D. slightly larger than (B) O.D.
(B) I.D. slightly larger than (C) O.D.

Male Post Assy.
NO.1

Floor Socket Detail

Alternate Design Post
(no core drill)

LOW PROFILE SLIDABLE SHELF

CROSS REFERENCE TO RELATED APPLICATION

This application claims the benefit of U.S. Provisional No. 60/042,471 filed Mar. 27, 1997.

FIELD OF THE INVENTION

This invention relates to devices for enhancing the movement of objects relative to other objects. In particular, this invention relates to moving devices relative to delicatessen counters. More particularly, this invention relates to a "low-profile" frame assembly upon which a support member will slide.

OBJECT AND SUMMARY OF THE INVENTION

It is an object of the present invention to provide a sliding shelf system having a frame with an overall lower height and width than conventional frames.

Still another object of the present invention is to provide a slidable shelf system, which has a curved frame for guiding a slidable support member on a curved path rather than a linear path.

Another object of this invention is to provide a low profile frame that will allow easy access to a delicatessen case.

Still a further object of the present invention is to provide a slidable shelf system that is easier to install than conventional devices.

Yet another object of the present invention is to provide a frame support for a slidable work member, which does not have to be core drilled into the work area floor.

A further object of the present invention is to provide a low profile slidable shelf that will prevent the inadvertent removal of the sliding shelf from the frame.

Still a further object of the present invention is to provide a low profile slidable shelf system which is vibration resistant.

Yet another object of the present invention is to provide a low profile slidable shelf system, which is more economical to manufacture, install and maintain than conventional systems.

Various inventive features are set forth below and in the following: FIGS. 1, 2, 3, 4, 5A, 5B, 6, 7, 8, 9, 10, 11, 12, 13, 14, 15, 16A, 16B, 17, 18, 19, 20, 21, 22, 23, 24, 25, 26, 27, 28, 29, 30, and 31.

DETAILED DESCRIPTION OF THE INVENTION

My new low profile frame is user friendly in that the exposed rail, the portion of the frame where the support member is not located, is lower than conventional frames. Thus, a worker or user does not have to go through great effort to reach a nearby display case.

Figure 1:
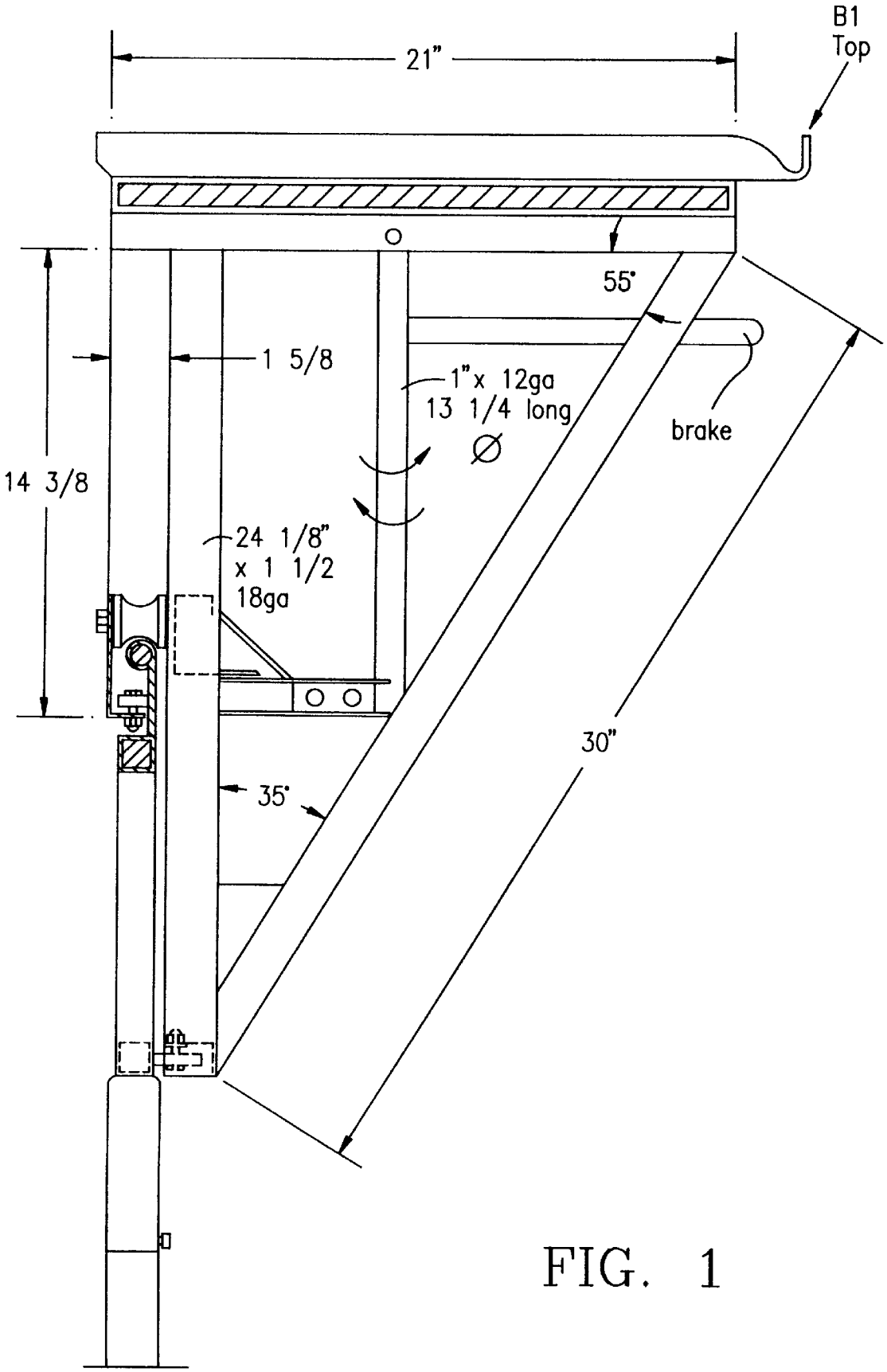
FIG. 1 is an end view of my new low profile sliding shelf system.
Figure 2:
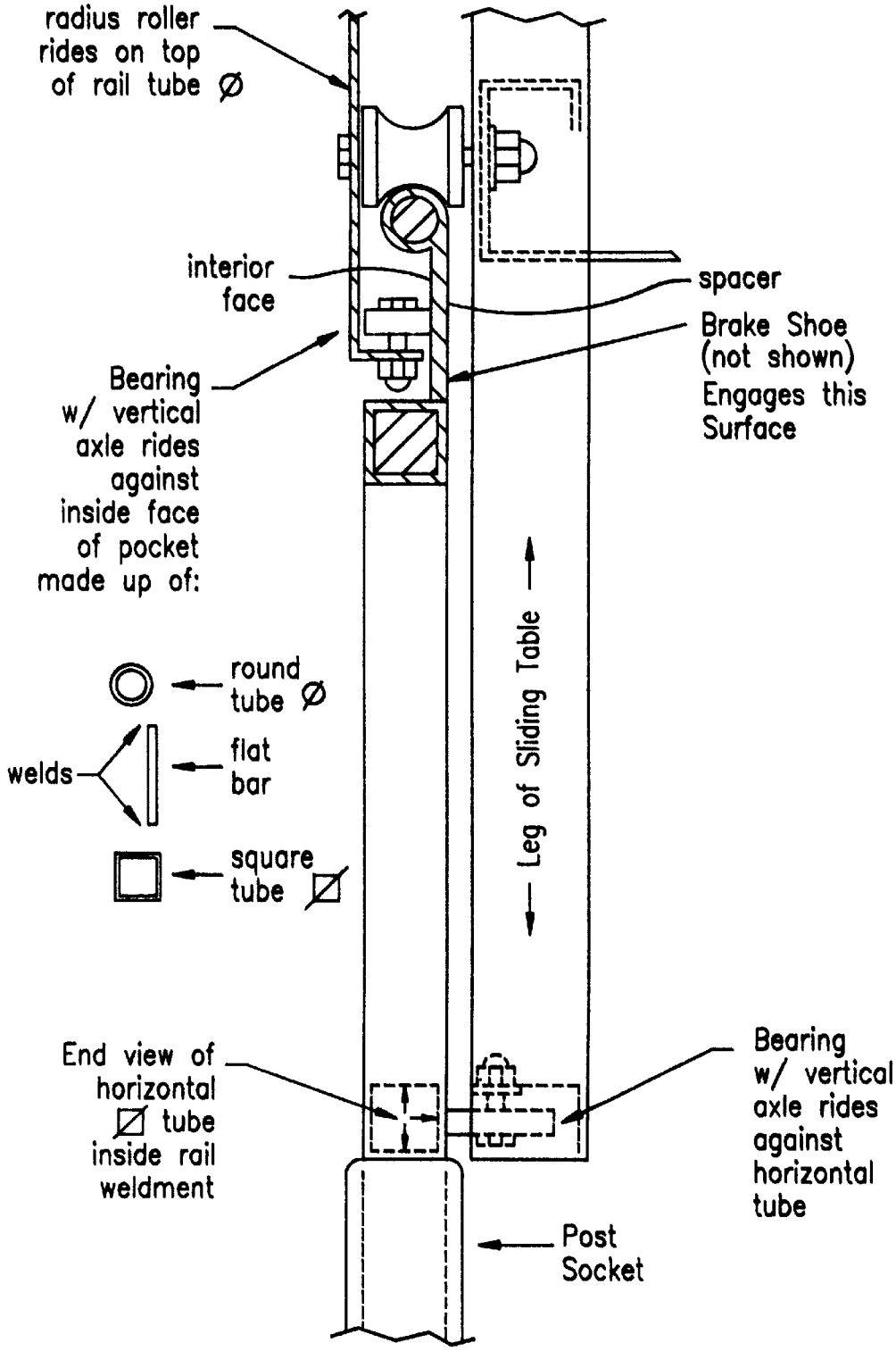
FIG. 2 is an enlarged end view of the system of FIG. 1, illustrating how the sliding work assembly engages the frame.
Figure 3:
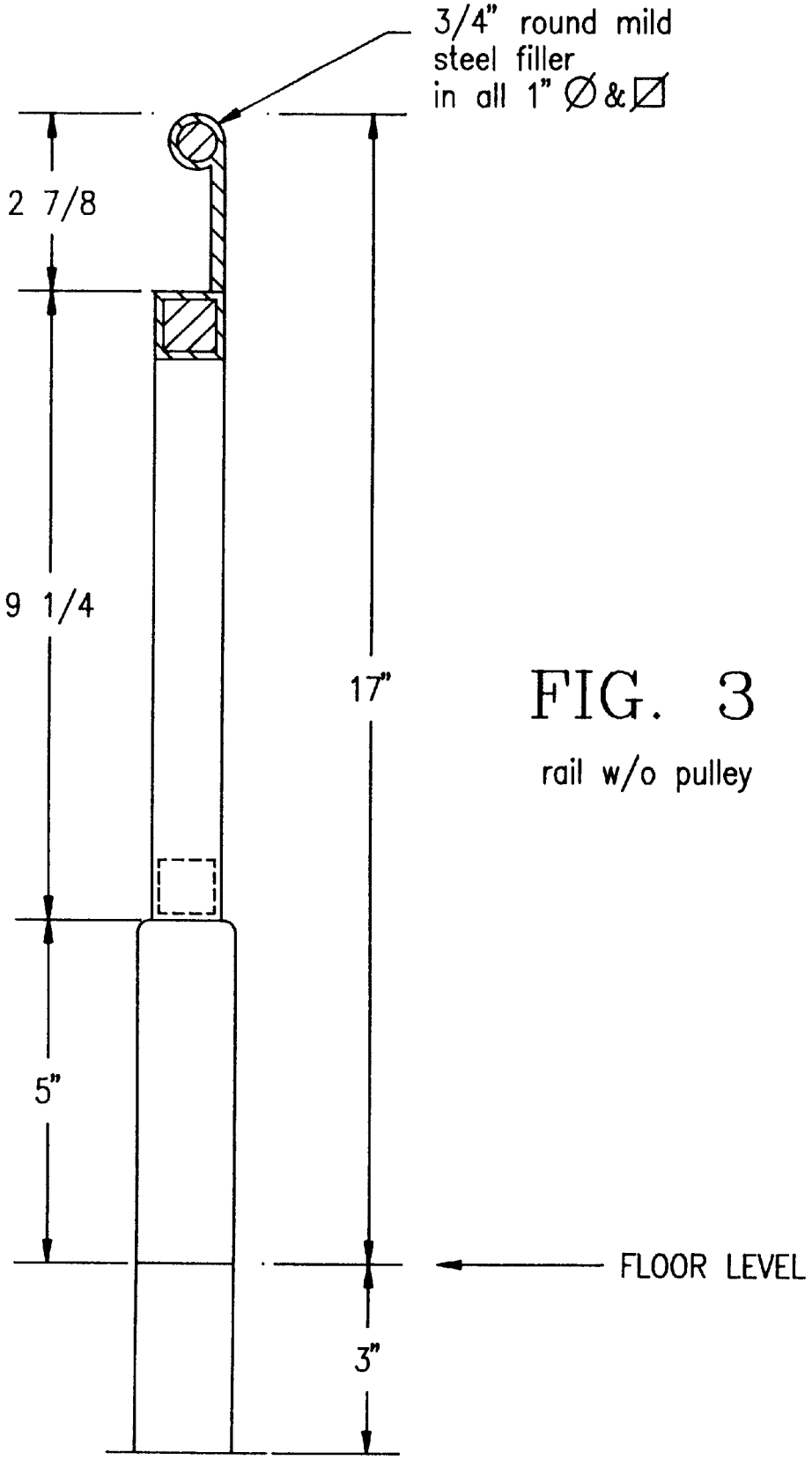
FIG. 3 is an end view of the frame component of FIG. 1.

As shown in FIGS. 1, 2 and 3, my new low profile frame employs round tubes, which help isolate vibration and allow the frame to have a curved shape, so that the work surface, supported by the support member, can be slid to various locations along two perpendicular, or nonlinear, display cases.

My new low profile frame also may employ interlocking sleeve assemblies for mounting the frame to a work area floor, as disclosed in FIGS. 5–14 and 22–26. This mounting design allows for easier installation of the frame to a work floor than conventional systems, because core drilling into the flooring is not required. In other words, the interlocking sleeve can be simply bolted to the floor, rather than having to be partially inserted into the floor.

Figure 15:
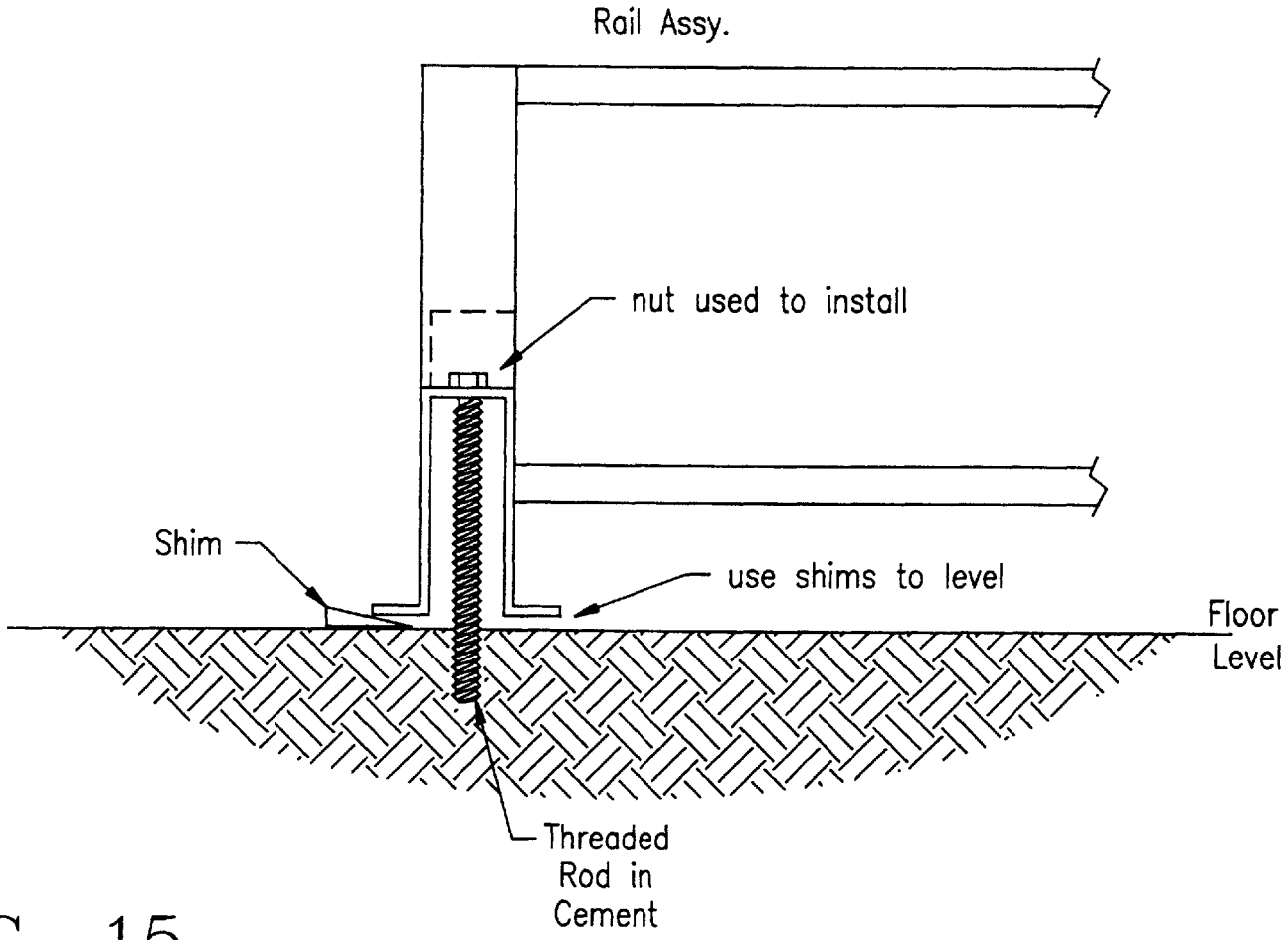
FIG. 15 is an elevational view of an alternative mounting design for mounting the frame to the floor.
Figure 16B:
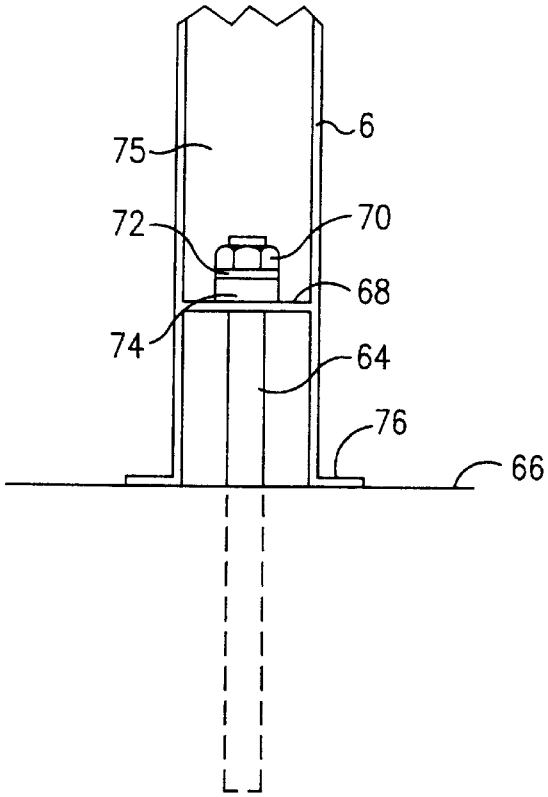
FIG. 16B is a front elevational view of the mounting of FIG. 15.
Figure 16A:
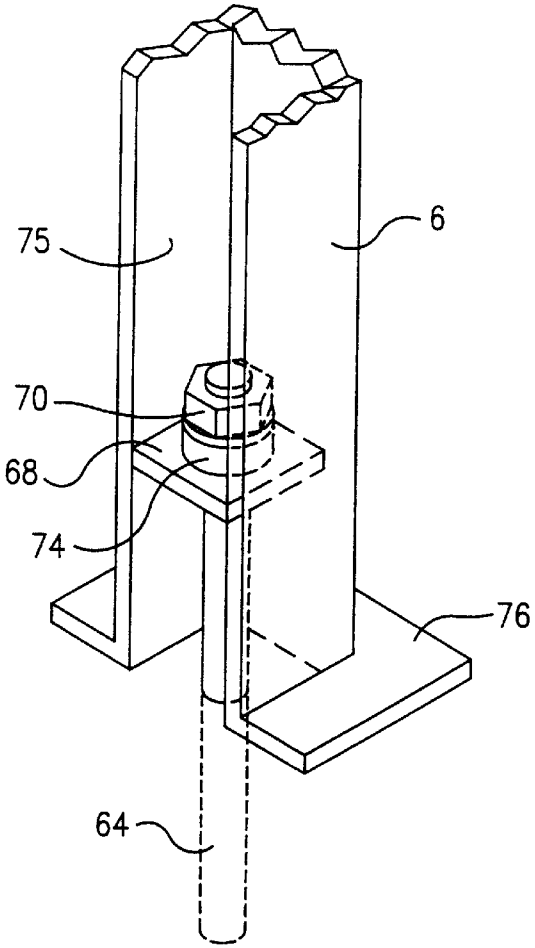
FIG. 16A is a perspective view of the mounting of FIG. 15.
Figure 17:
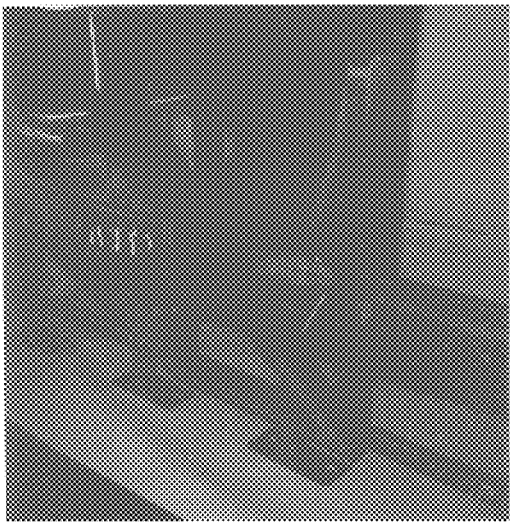
FIG. 17 is a partial perspective view of the low profile sliding surface system of FIG. 1.
Figure 18:
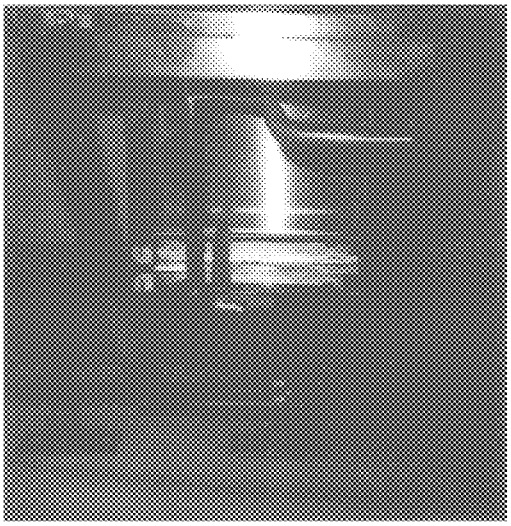
FIG. 18 is a partial front elevational view of the low profile sliding shelf system of FIG. 1.
Figure 19:
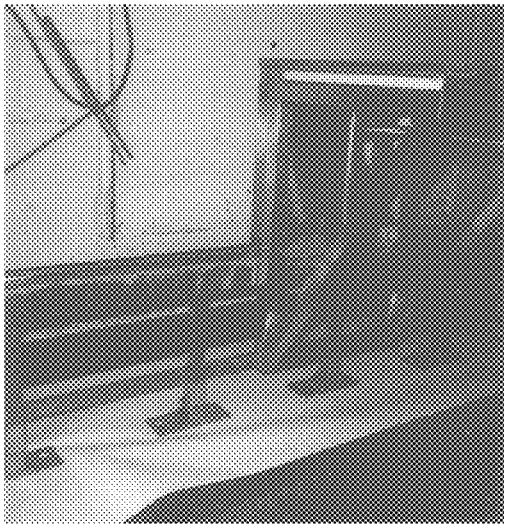
FIG. 19 is a perspective view of the low profile sliding shelf system, showing the sliding support member and the low profile frame, of FIG. 1.
Figure 20:
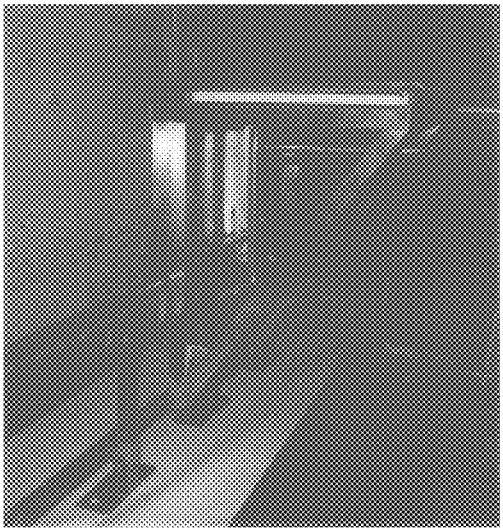
FIG. 20 is a partial side perspective view of the low profile sliding shelf system of FIG. 1.
Figure 21:
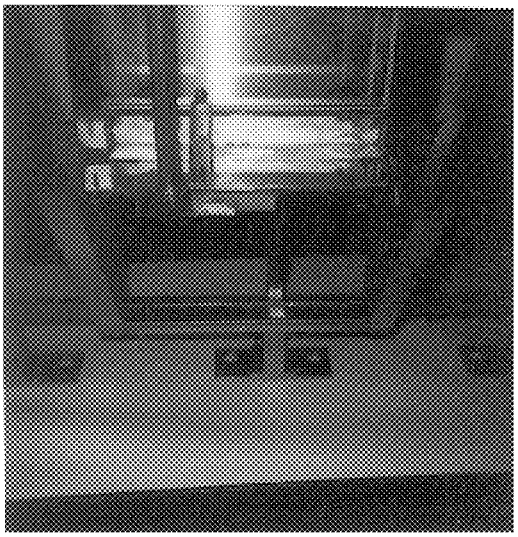
FIG. 21 is a partial front perspective view of the low profile sliding shelf system of FIG. 1.
Figure 22:
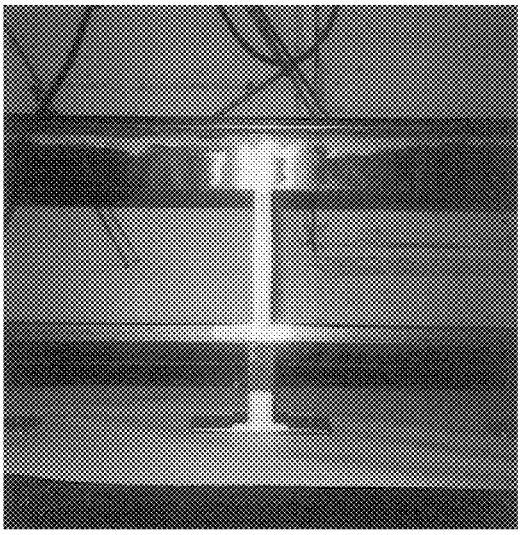
FIG. 22 is a partial front elevational view of the frame component of the sliding shelf system of FIG. 1, illustrating the interlocking assembly of FIG. 5A.
Figure 23:
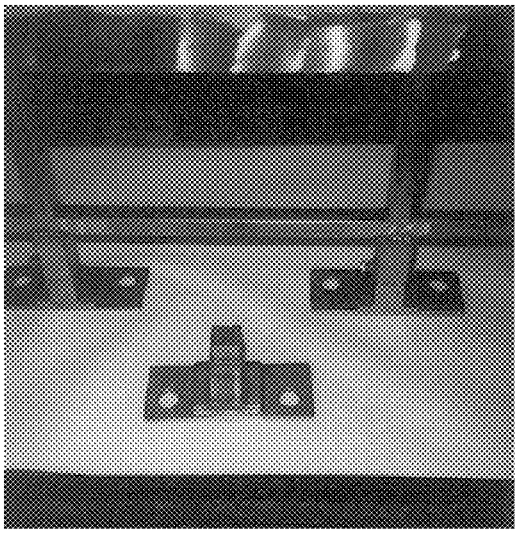
FIG. 23 is a perspective view of the floor socket component of the interlocking sleeve assembly of FIG. 5A in the foreground and a partial perspective view of the frame component in the background.
Figure 24:
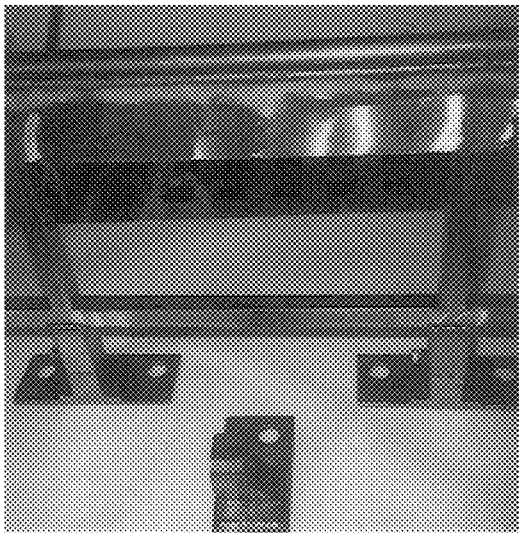
FIG. 24 is a side perspective view of the floor socket component of the interlocking sleeve assembly of FIG. 5A in the foreground and a partial perspective view of the frame component of the sliding shelf system of FIG. 1.
Figure 25:
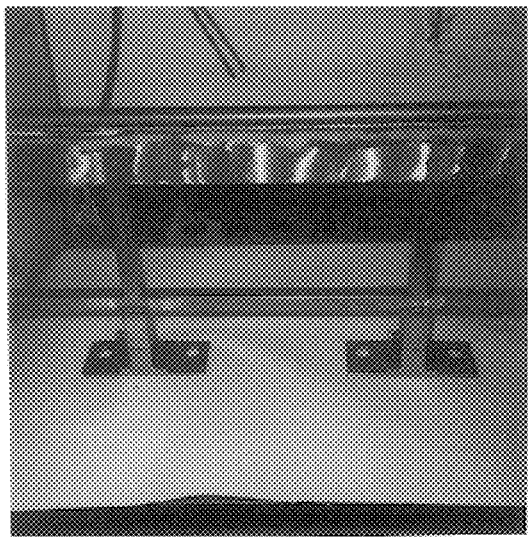
FIG. 25 is a partial front perspective view of the frame component of the low profile sliding shelf system of FIG. 1.
Figure 26:
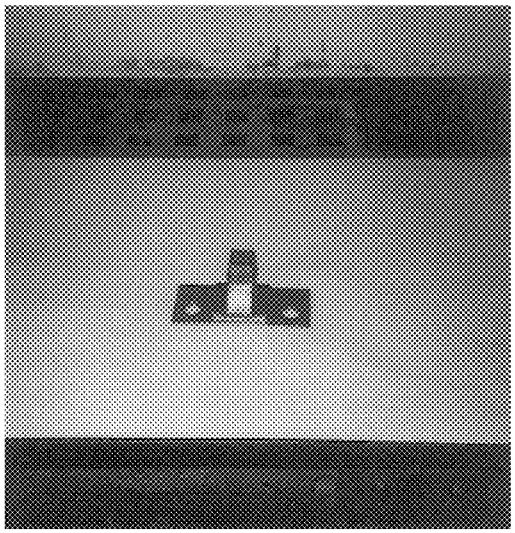
FIG. 26 is a front perspective view of the floor socket component of the interlocking sleeve assembly of FIG. 5A.
Figure 27:
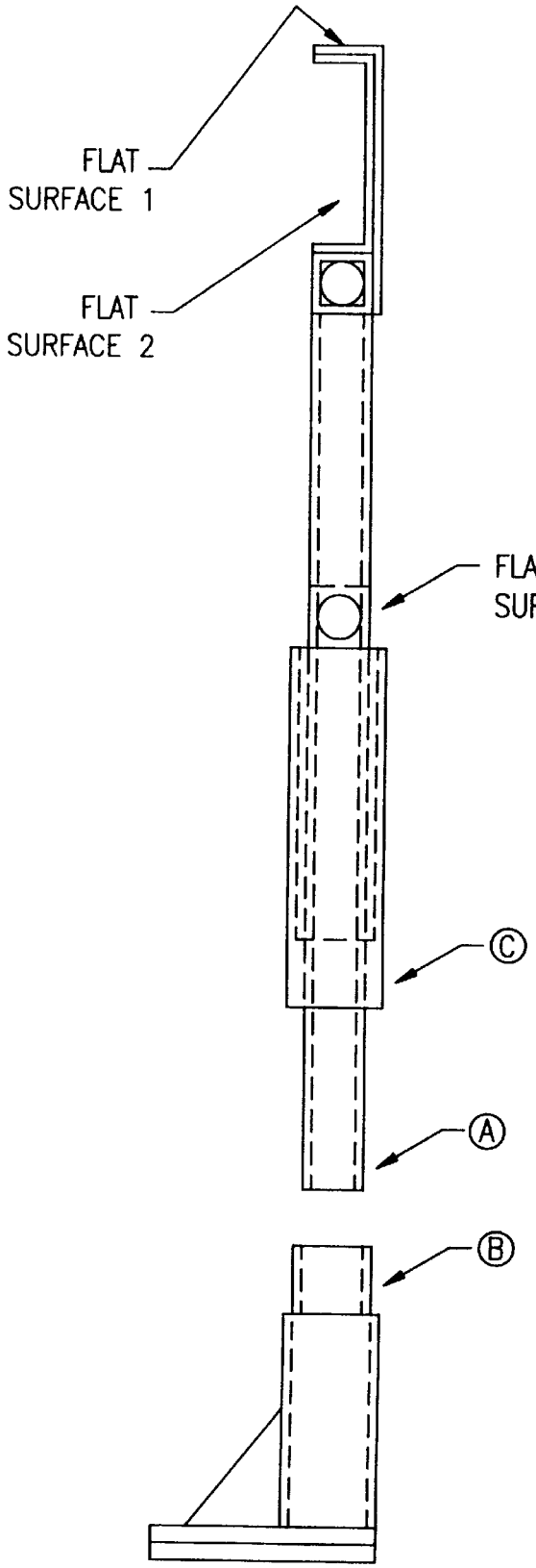
FIG. 27 is an end view similar to FIGS. 2 and 3, illustrating another preferred embodiment of a frame component according to the invention.
Figure 28:
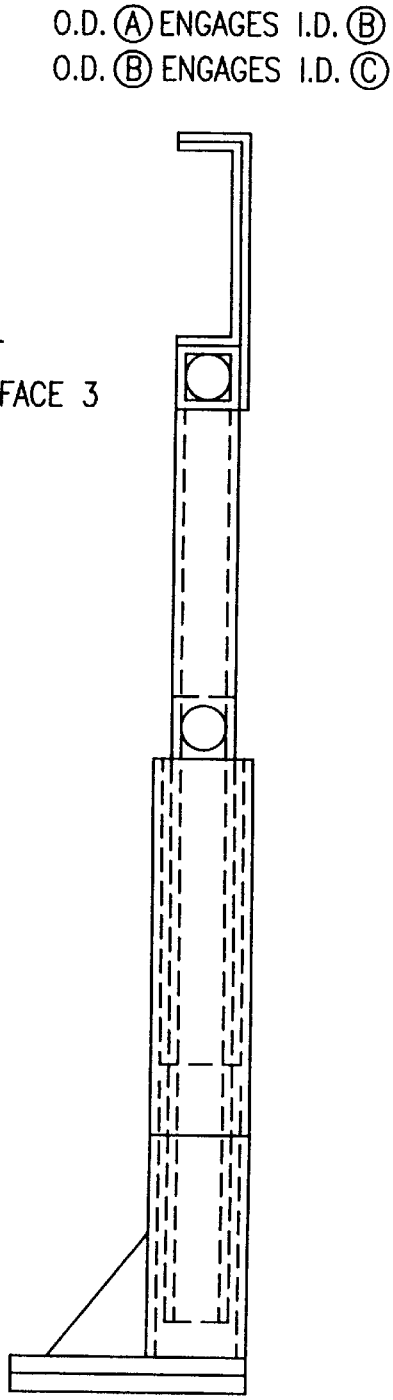
FIG. 28 illustrates the manner in which elements A and C engage element B of the exploded view of FIG. 27.
Figure 29:
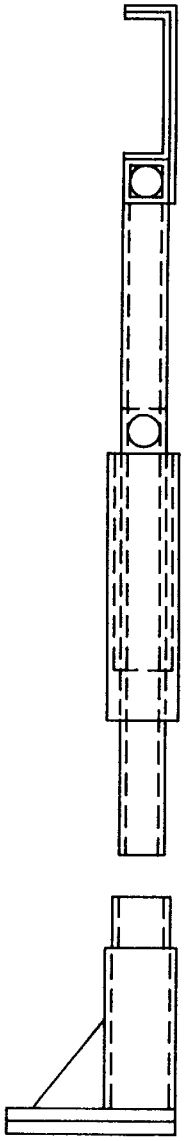
FIG. 29 is a further exploded view of the embodiment of FIG. 27.
Figure 31:
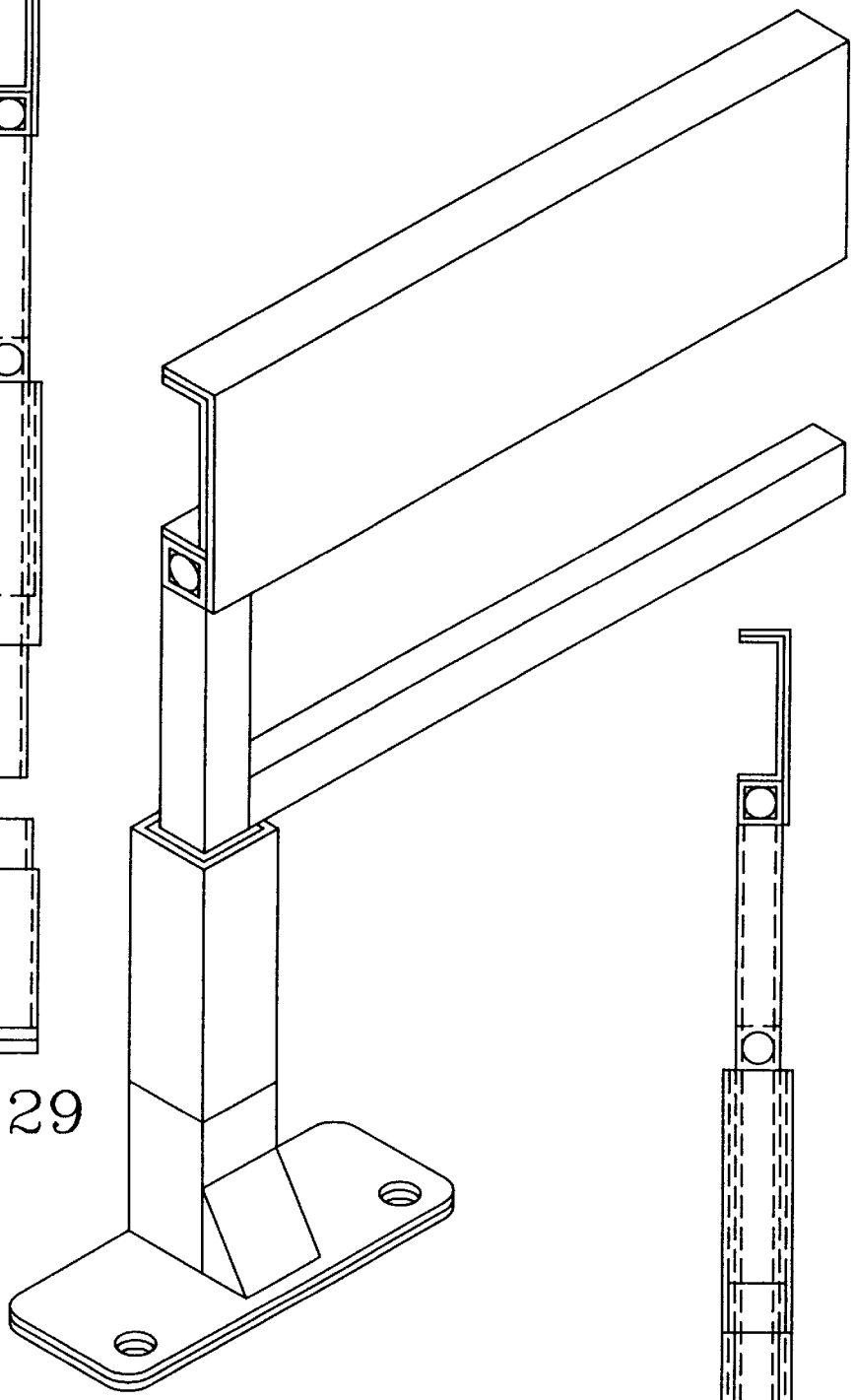
FIG. 31 is a partial perspective view of the embodiment of FIG. 27, similar to FIG. 5, for example.
Figure 30:
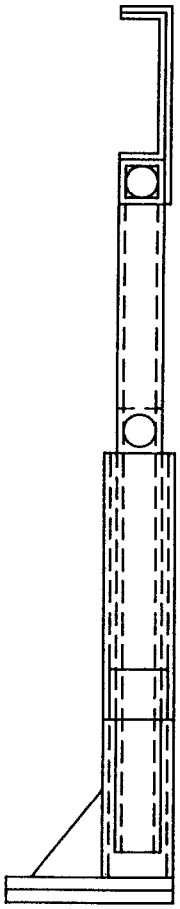
FIG. 30 is a further view, similar to FIG. 28, on a reduced scale.

The frame can also be attached to the floor with a threaded rod or screw that is drilled into the flooring of the work area, as shown in FIGS. 15, 16A and 16B. Referring specifically to FIGS. 16A and 16B, a threaded rod 64 is shown extending from the floor line 66 and into the upright 6, of the frame. To lock or secure the upright 6 to the rod 64, the upright 6 has a horizontal member 68 that the rod 64 extends through and then a nut 70, a washer 72 and a rubber dampener 74 are threaded on to the rod 64. The rubber dampener 74 will help eliminate vibration transfer from the floor to the upright 6.

To tighten and loosen the nut 70, the upright 6 may have an open face 75. In other words, only a portion of the wall of the upright 6 may be removed to allow access to the nut 70.

To stabilize the upright 6, it has a flange 76 located at its base for engagement with the floor much like the mounting plates 34 discussed above. Some work area floors are not perfectly level. As such, it is possible that the flange 76 may not completely engage the floor. Thus, shims, shown in FIG. 15 are employed, by wedging the shims under the flange 76, to level the upright 6 or compensate for the varying contours of the floor.

My new low profile frame provides a reduction in overall height of about 30 to 50 percent, from the conventional frame. More particularly, the height of a prototype of my invention is about 13 inches to about 17 inches, rather than the height of about 26 inches for conventional frames.

My new low profile frame provides a reduction in overall distance from the back of a deli case to the front of the rail by about 40 to about 50 percent, accompanied to a conventional frame.

More particularly, the overall distance from the back of a deli case to the front of the rail, or frame, will be reduced from about 5.5 inches, for a conventional frame, to about 3 inches.

Figure 4:
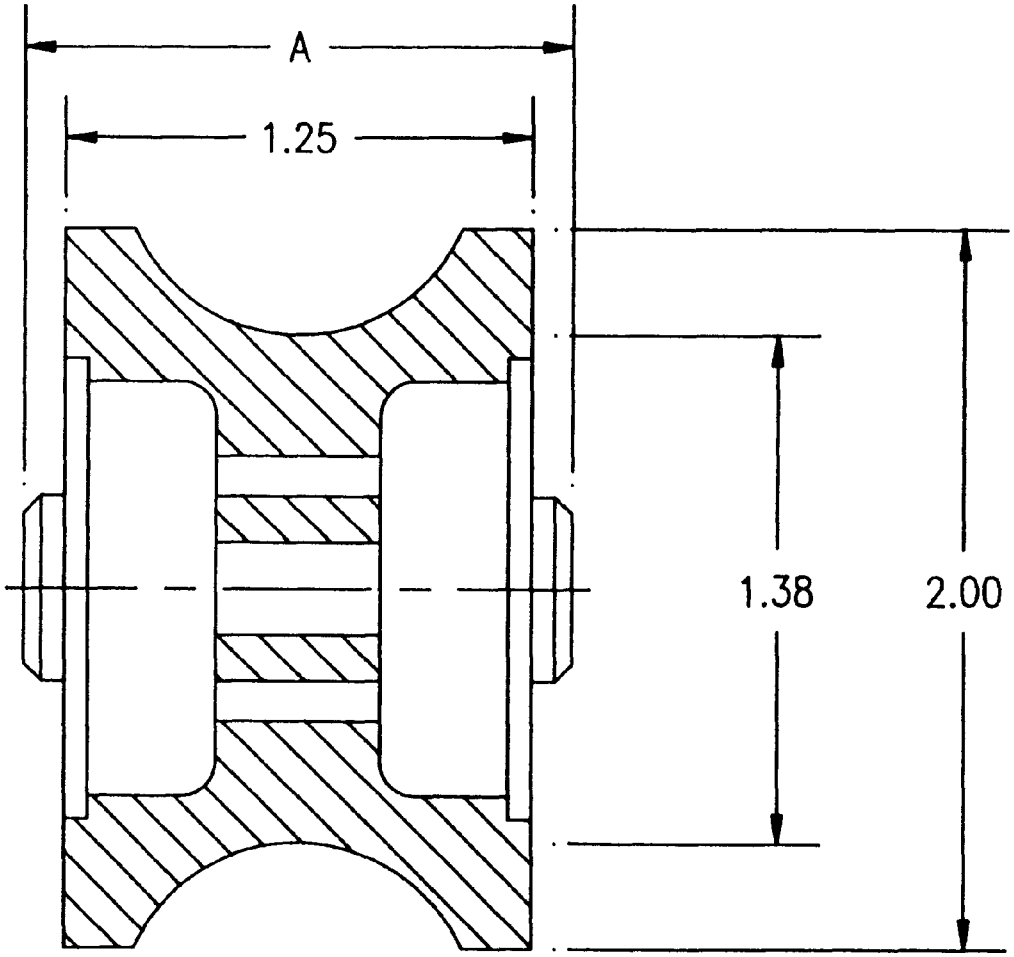
FIG. 4 is an enlarged partial cross sectional view of the top roller, which rides or engages the round tube or guide of the frame of FIG. 2.
Figure 5B:
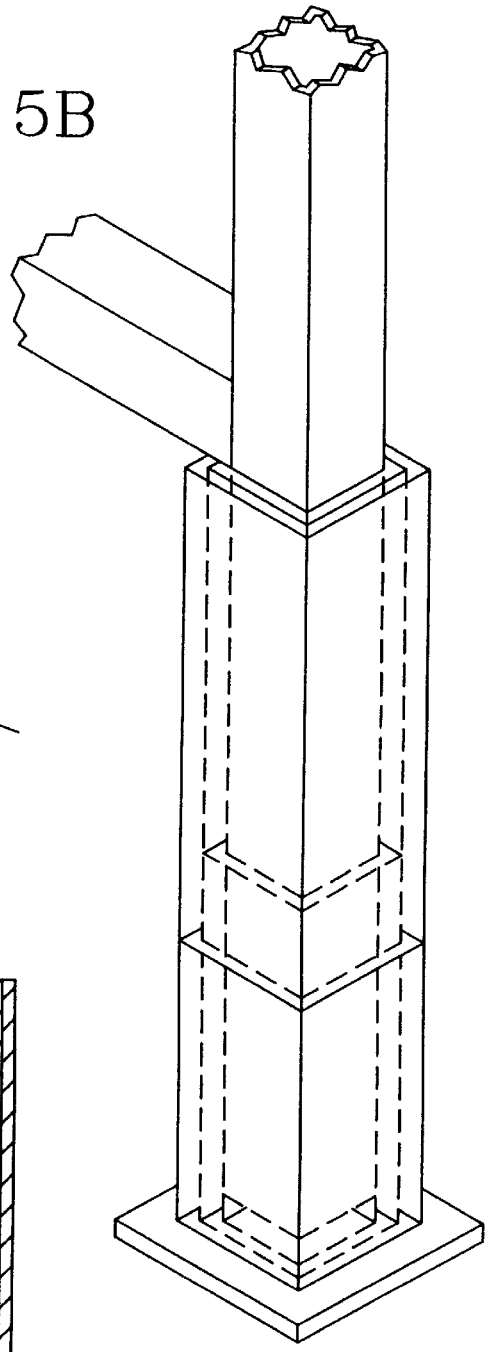
FIG. 5B is a perspective view of the interlocking sleeve assembly of FIG. 5A.
Figure 5A:
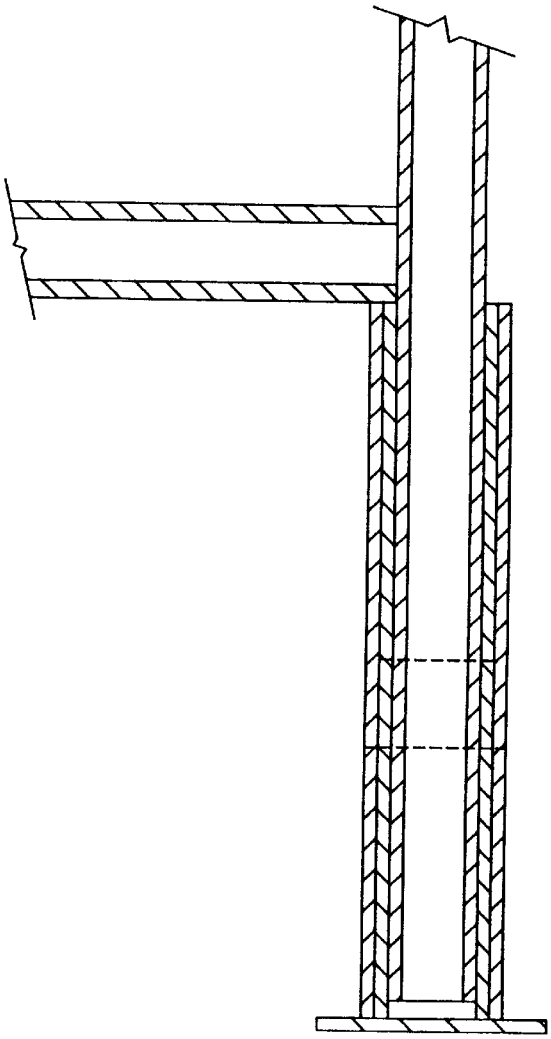
FIG. 5A is an enlarged front elevational view of the interlocking sleeve assembly, of the frame, for mounting the frame to the floor.
Figure 6:
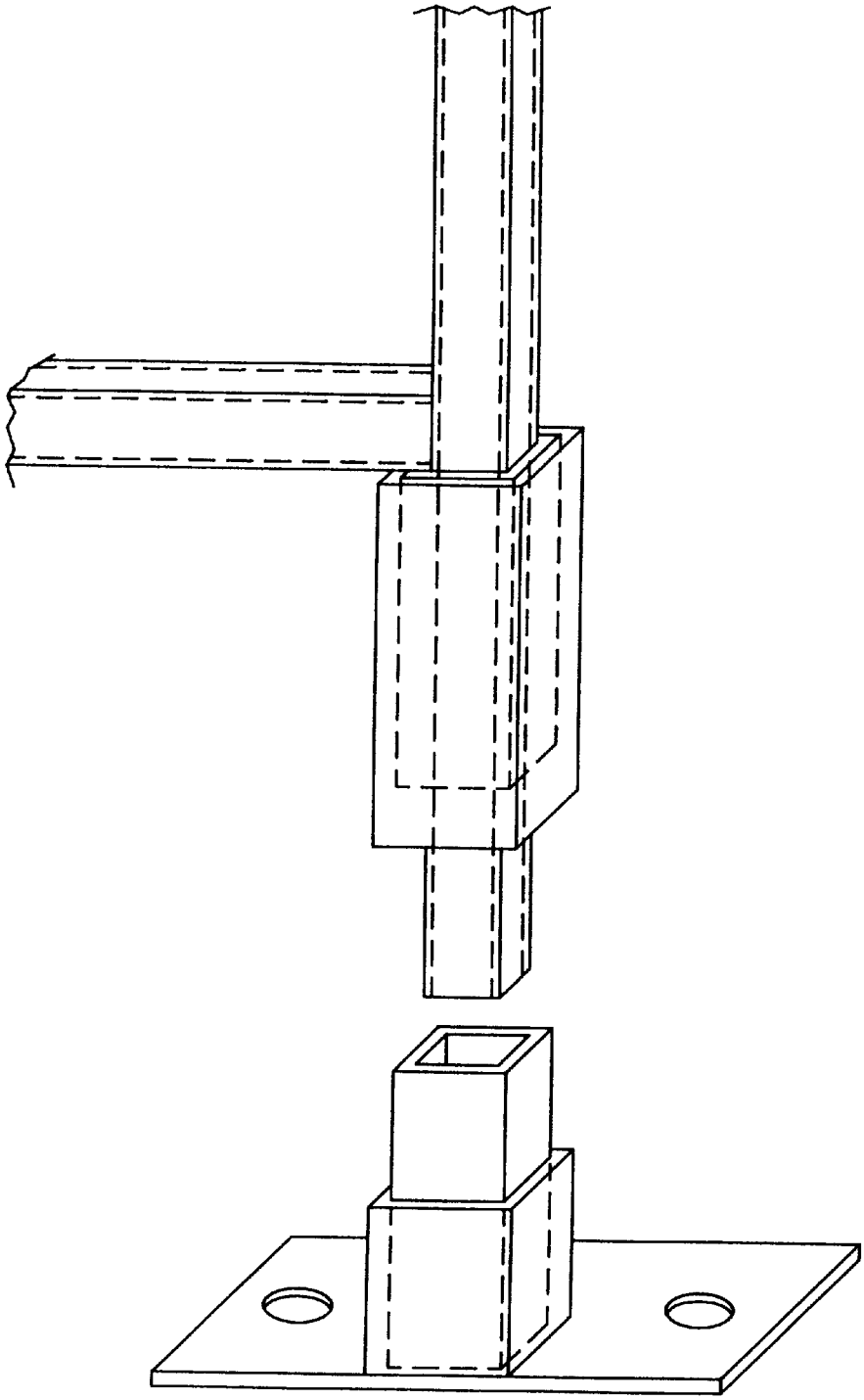
FIG. 6 is an exploded view of the interlocking sleeve assembly of FIG. 5A.
Figure 7:
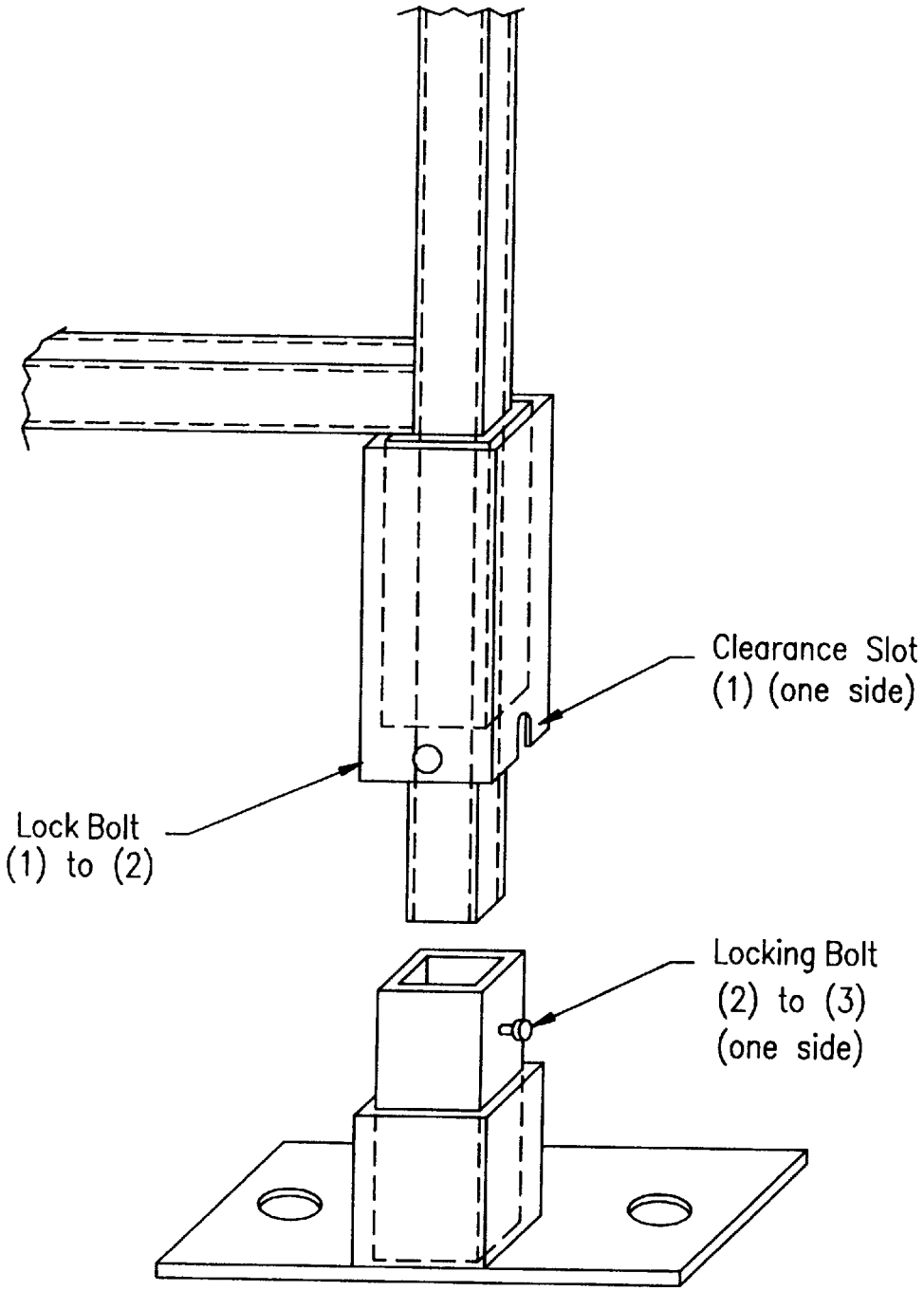
FIG. 7 is an exploded view of the interlocking sleeve illustrating how the height of each leg or upright, of the frame, can be adjusted.
Figure 8:
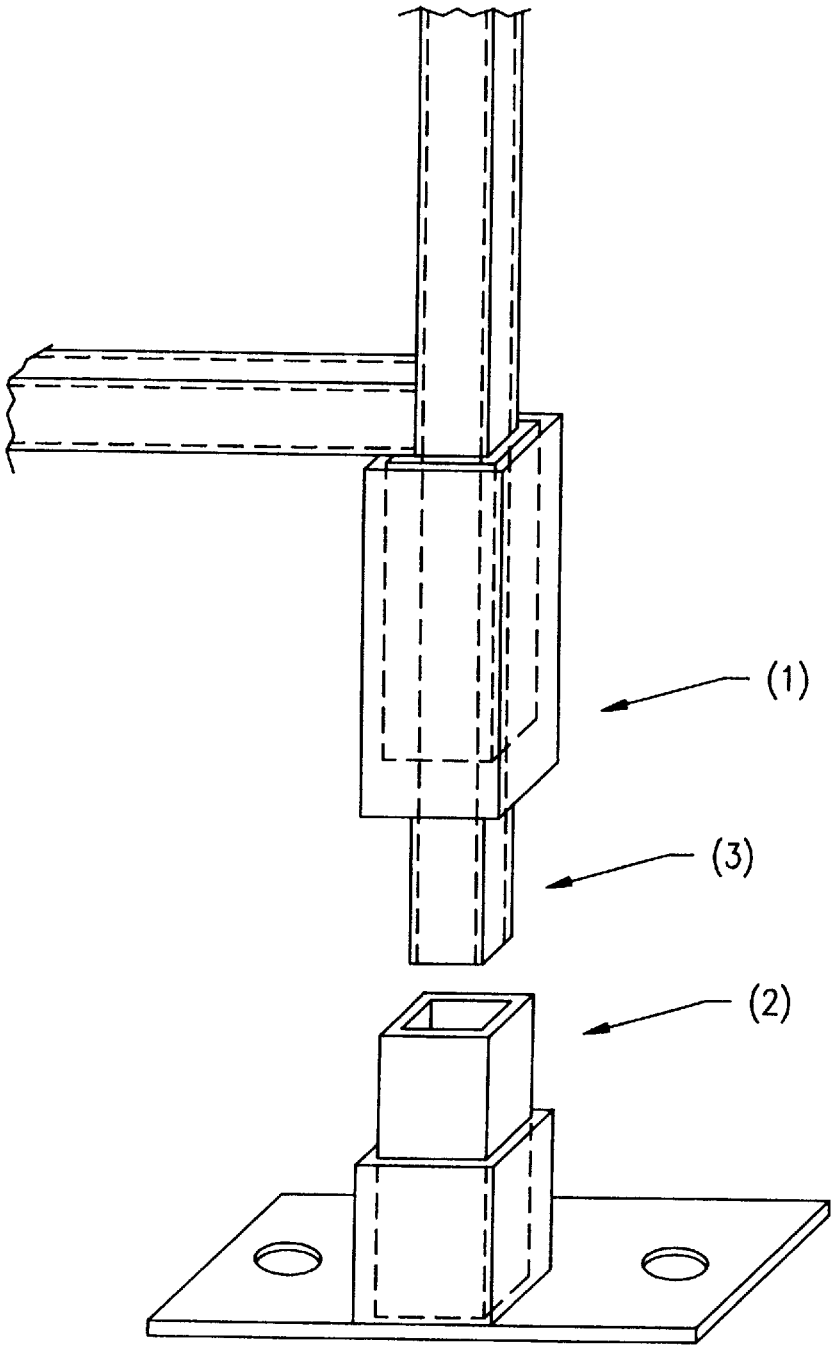
FIG. 8 is an exploded view of the interlocking sleeve assembly of FIG. 5A.
Figure 9:
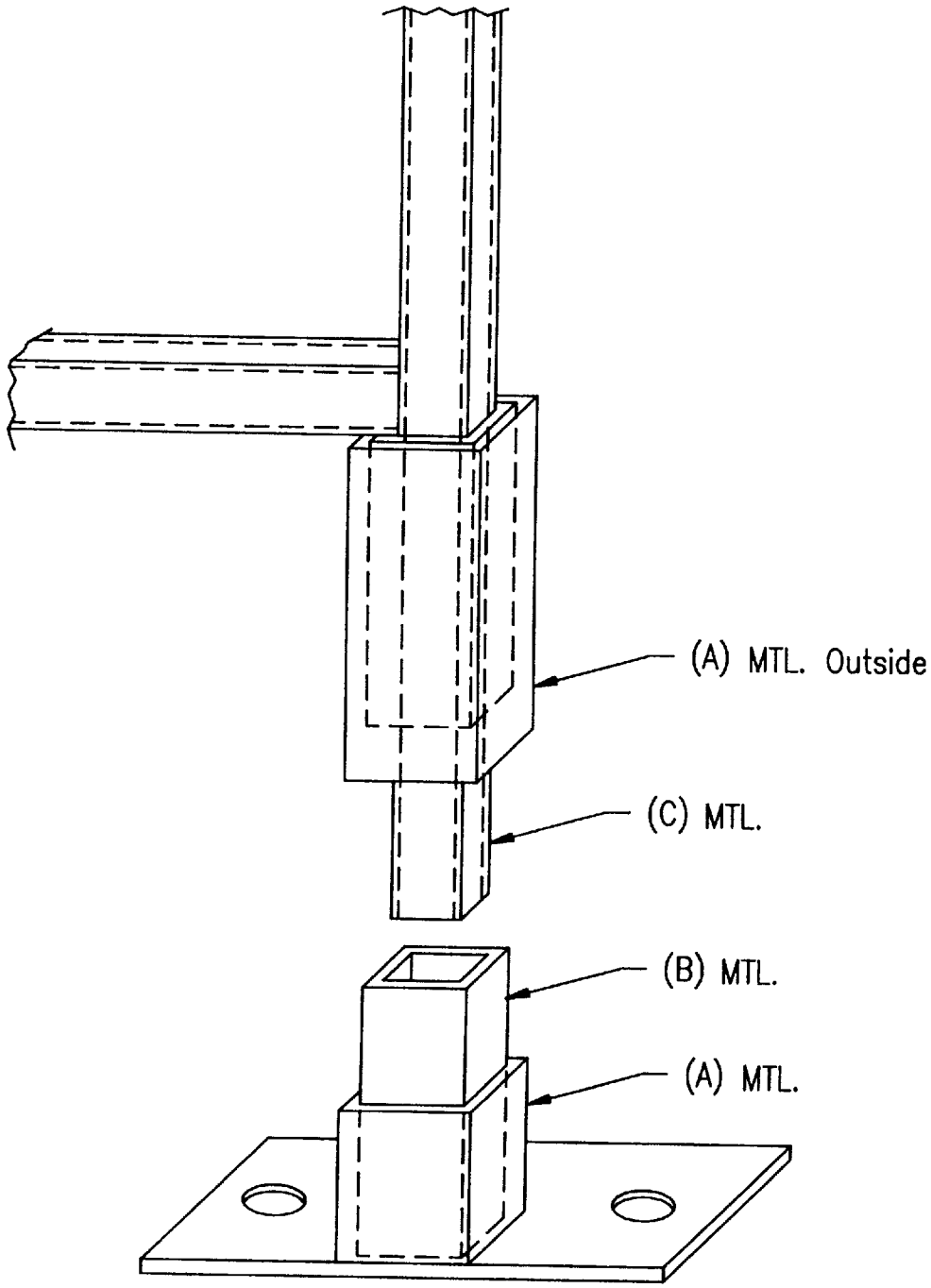
FIG. 9 is an exploded view of the interlocking sleeve assembly of FIG. 5A.
Figure 10:
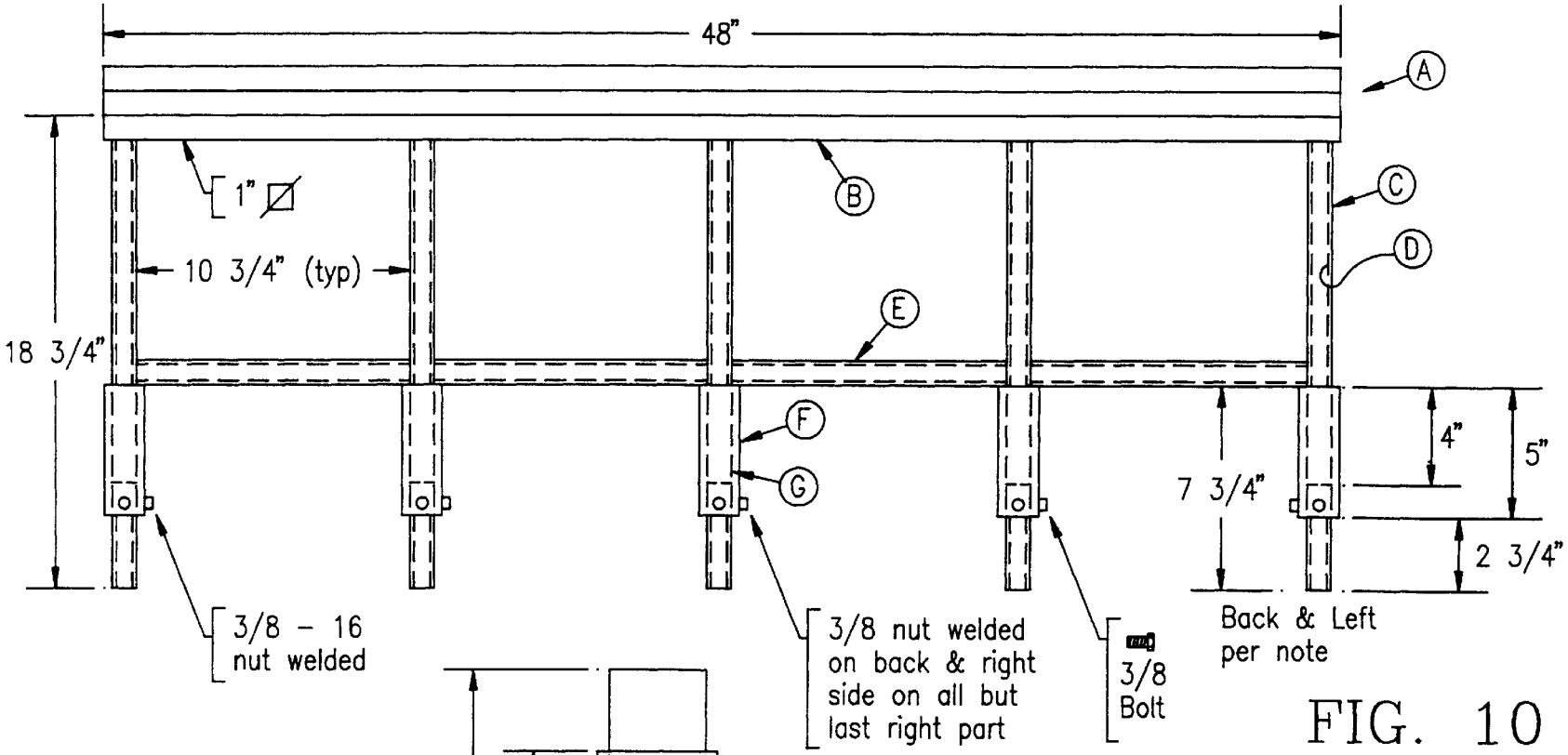
FIG. 10 is a front elevational view of the frame.
Figure 11:
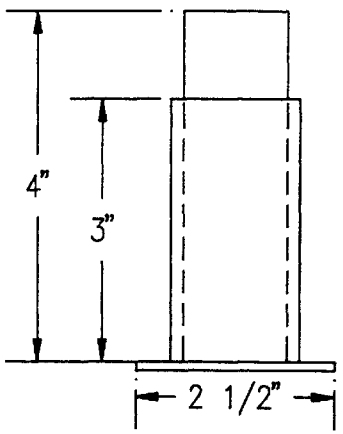
FIG. 11 is an exploded view of a component of the interlocking sleeve assembly of FIG. 5A.
Figure 12:
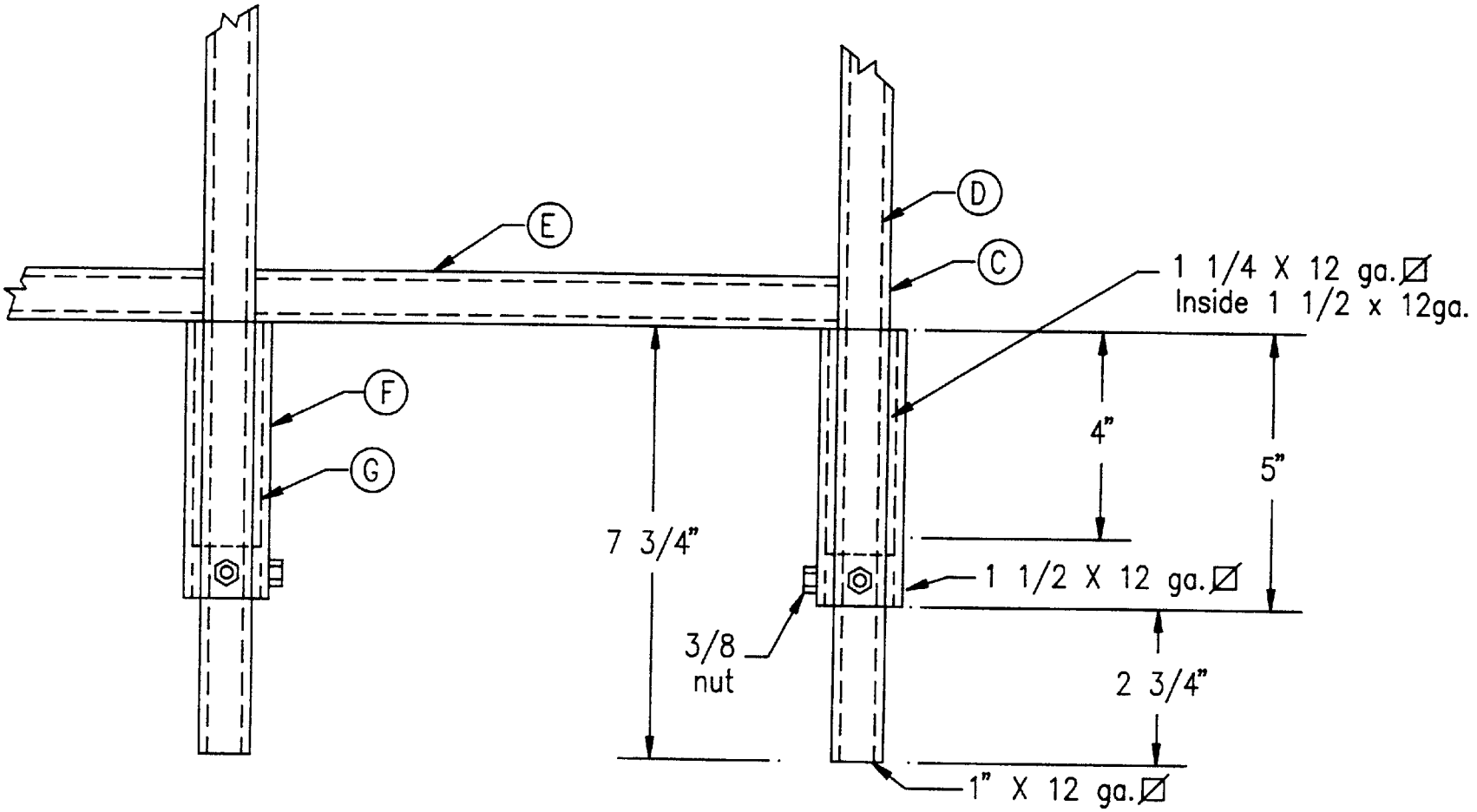
FIG. 12 is an enlarged front elevational view of the male post assembly component of the interlocking sleeve assembly of FIG. 5A.
Figure 13:
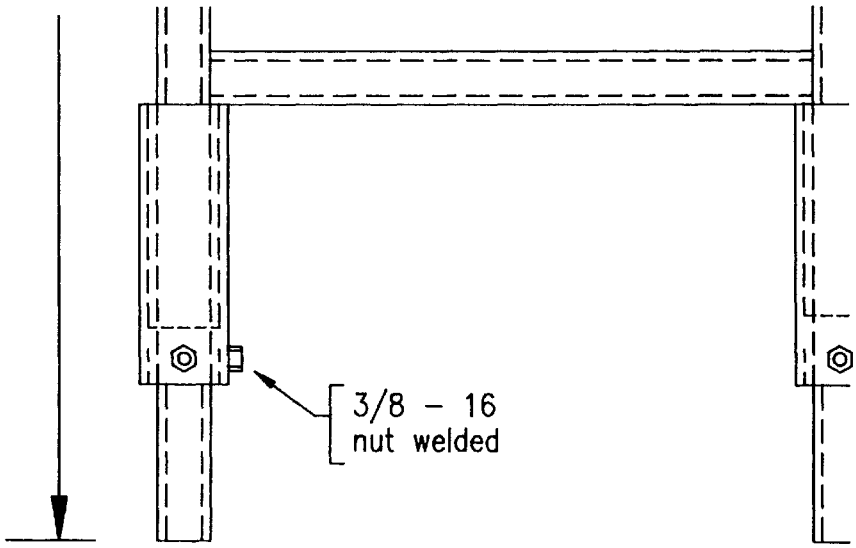
FIG. 13 is an enlarged view of a portion of the interlocking sleeve assembly of FIG. 5A.
Figure 14:
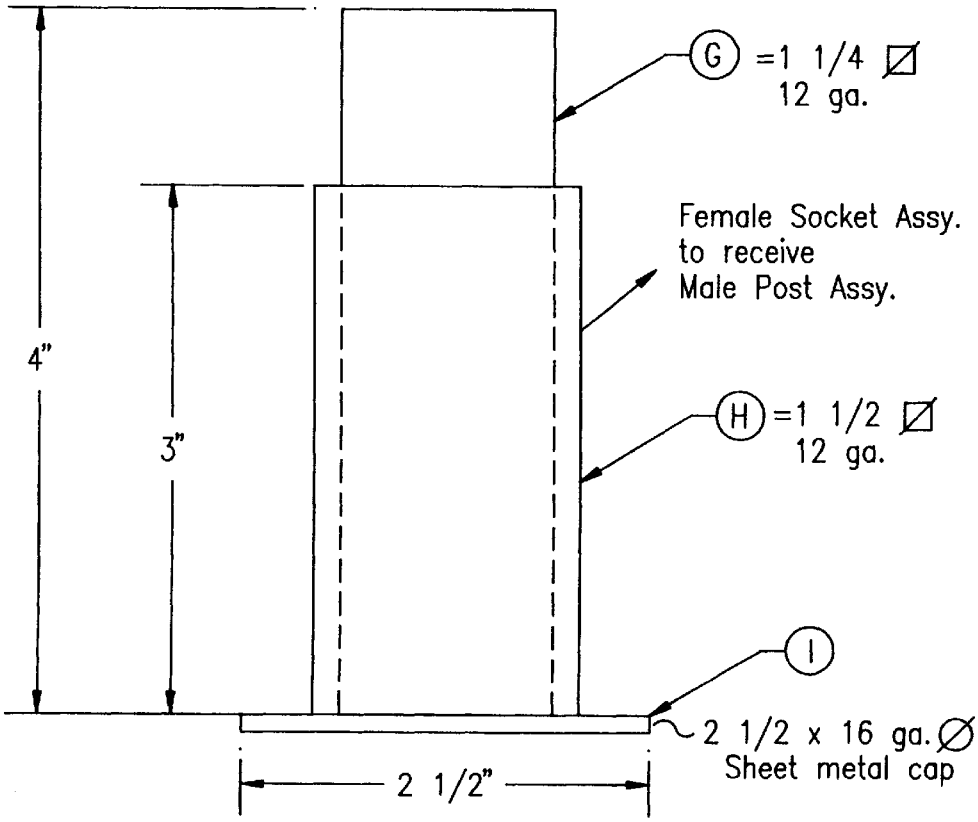
FIG. 14 is an enlarged front elevational view of the floor socket component of the interlocking sleeve assembly of FIG. 5A.

To further reduce vibration transfer from the ground to the support member, which slides along the frame, vibration absorbing wheels can be employed for all the rollers engaging the frame, and in particular for the top roller as shown in FIGS. 1, 3 and 4.

My new low profile frame also has a smaller floor plate for ease of cleaning the floor.

Additionally, to reduce vibration transfer from the ground through the frame, the frame members are preferred to be hollow. The walls of the frame members are preferred to be of three layers of dissimilar materials. The hollow portion of the frame members can be filled with vibration absorbing material such as lead shot or foam.

In the embodiment of FIGS. 27–31, given that a flat surface 1 replaces the un-numbered round tube of the embodiment of FIG. 2, the radiused roller of the FIG. 2 embodiment need not be used; rather, a bearing may be used on flat surface 1. As in the embodiment of FIG. 2, a second bearing may ride on flat surface 2, and a third bearing may ride on flat surface 3. In sum, three unillustrated bearings may be used in the embodiment of FIG. 27, as opposed to the one radiused roller and two illustrated bearings of the body of FIG. 2. Such bearings may be ball-bearings, roller-bearings, rubber wheels, and the like, depending on the intended use.

While this invention has been described as having a preferred design, it is understood that it is capable of further modifications, uses, and/or adaptations of the invention following, in general, the principle of the invention and including such departures from the present disclosure as come within the known or customary practice in the art to which the invention pertains and, as may be applied to the central features herein before set forth, and fall within the scope of the invention and of the limits of the appended claims.

I claim:

1. A device comprising:

a) a first and second upright;

b) a support rail connecting said first upright and said second upright;

c) a vertical spacer having a first edge, a second edge and a bearing surface, a portion of said first edge being disposed on said first upright and a portion of said first edge being disposed on said second upright;

d) a guide rail having a top surface and being disposed along said second edge of said vertical spacer, said guide rail extending over said bearing surface;

e) a sliding support member having a first roller, a second roller and a third roller;

f) said first roller engaging said top surface and being oriented for transmitting substantially only vertical forces from said sliding support member to said top surface;

g) said second roller engaging said support rail and being oriented for transmitting substantially only horizontal forces from said sliding support member to said support rail; and, h) said third roller being disposed beneath said top surface of said guide rail and said first roller, and engaging said bearing surface of said vertical spacer, said third roller being oriented for transmitting substantially only horizontal forces from said sliding support member to said bearing surface.

2. The device as recited in claim 1, wherein:

a) said guide rail has a generally circular cross section.

3. The device as recited in claim 1, wherein:

a) said first roller comprises a radiused roller.

4. The device as recited in claim 1, wherein:

a) said guide rail has a generally rectangular cross section.

* * * * *